United States Patent [19]

Kelley

[11] 4,308,449

[45] Dec. 29, 1981

[54] TACTICAL NUCLEAR SLIDE RULE

[75] Inventor: Clair S. Kelley, Reston, Va.

[73] Assignee: The United States of America as represented by the Secretary of the Army, Washington, D.C.

[21] Appl. No.: 928,219

[22] Filed: Jul. 26, 1978

[51] Int. Cl.[3] ..... G06G 1/02

[52] U.S. Cl. ..... 235/70 A; 235/70 C

[58] Field of Search ..... 235/70 A, 70 R, 70 B, 235/70 C

[56] References Cited

U.S. PATENT DOCUMENTS 2,138,879 12/1938 Poole ..... 235/70 B 4,028,529 6/1977 Van de Weghe ..... 235/70 A

OTHER PUBLICATIONS

"Special Slide Rules", J. N. Arnold, Extension Series No. 32, Purdue University, Lafayette, Indiana, pp. 19–25, Sep. 1933.

*Primary Examiner*—L. T. Hix

*Assistant Examiner*—Benjamin R. Fuller

*Attorney, Agent, or Firm*—Nathan Edelberg; Robert P. Gibson; Saul Elbaum

[57] ABSTRACT

A calculational aid is provided, in the form of a slide rule, to facilitate calculation of damages inflicted by a nuclear detonation. The particular apparatus permits calculation of the effects of an air blast, due to static overpressure, resulting from such a detonation. Appropriate scales, properly spaced in particular relationships, are provided on a slide rule, thus providing a means for performing the calculational functions described above. The calculations utilize five parameters, and the present invention provides an apparatus for determining any one of the five parameters once the other four are known.

8 Claims, 2 Drawing Figures

TACTICAL NUCLEAR SLIDE RULE

RIGHTS OF THE GOVERNMENT

The invention described herein may be manufactured, used, and licensed by or for the U.S. Government for governmental purposes without the payment to me of any royalty thereon.

BACKGROUND OF THE INVENTION

1. Field of the Invention

The present invention relates to calculational devices, and more particularly to apparatus having indicia and scales properly placed thereon to enable the computation of specific functions relating to probability of damage resulting from a nuclear explosion.

The present apparatus combines a means for computation of a particular environmental parameter for a detonation with a further means for computing a probability of damage responsive to the computed environmental parameter.

2. Prior Art

Prior art computational devices are known, particularly in the form of slide rules. However, such devices are not available for the computation of the parameters and probabilities hereinabove described.

Thus, while algorithms are known for computation of static overpressure, for example, resulting from a nuclear detonation, given the particular weapon yield, distance from the detonation and two vulnerability parameters, (see William E. Sweeney, Jr., Cyrus Moazed, and John S. Wicklund, Nuclear Weapons Environments for Vulnerability Assessments to Support Tactical Nuclear Warfare Studies (U), Harry Diamond Laboratories TM-77-4 (June, 1977). (CONFIDENTIAL)), no single device is known to enable computation of the parameters as herein described, and particularly to compute the probability of damage. Prior art calculation of such answers requires the utilization of complex electronic computing devices, involving the expenditure of significant amounts of time and funds for the programming thereof. Step-by-step solutions utilizing calculators are also available, but again require expenditure of time in the solution of the equation. While a prior art computing apparatus is available for calculating the environmental parameter resulting from a nuclear detonation, the device does not provide any means for utilizing the resultant parameter to compute the probability of damage as provided by the present apparatus.

BRIEF DESCRIPTION OF THE DRAWINGS

These and other objects, features, and advantages of the present invention will become more readily apparent from the following specification and appended claims, when considered in conjunction with the attached drawings, in which:

SUMMARY AND OBJECTS OF THE INVENTION

In accordance with the present invention, a slide rule is provided having a slide, a stationary body and a movable cursor.

The front side of the slide includes a graduated scale dispiaying the yield of the particular weapon, and a second scale is provided for entry of an environmental parameter pertaining to a vulnerability parameter.

The front face of the stationary part of the slide rule includes a scale indicating the distance from the detonation site, and a second scale pertaining to the environmental parameter desired to be calculated.

The back of the slide rule includes scales utilized to compute the probability of damage to an item experiencing the environment calculated on the front face. Thus, a scale is provided for displaying the probability of damage on the stationary part, and a second vulnerability parameter, relating to the way the probability result changes upon changes in the environmental parameter, is provided on the back of the slide.

In accordance with the above description, it is an object of the invention to overcome the difficulties found in the prior art.

It is a primary object of the invention to provide an apparatus for computing the probability of damage to an object situated at a particular distance from a detonation site, given environmental parameter data.

It is another object of the invention to provide a means for computing an environmental parameter for use in the calculation of the probability of damage.

Yet another object of the invention is the provision of a slide rule for performing the above calculations.

A further object of the invention is the provision of a calculating device for determining any one of five parameters utilized in an equation, given at the other four.

It is still a further object of the invention to provide means for calculating one of a variety of answers to an equation without requiring reprogramming for each such solution.

Still another object of the invention is the provision of a computing apparatus for the probability of nuclear damage wherein the operator may readily retrace the steps to permit viewing the individual parameters utilized in the process of solution.

DETAILED DESCRIPTION OF A PREFERRED EMBODIMENT

Figure 1:
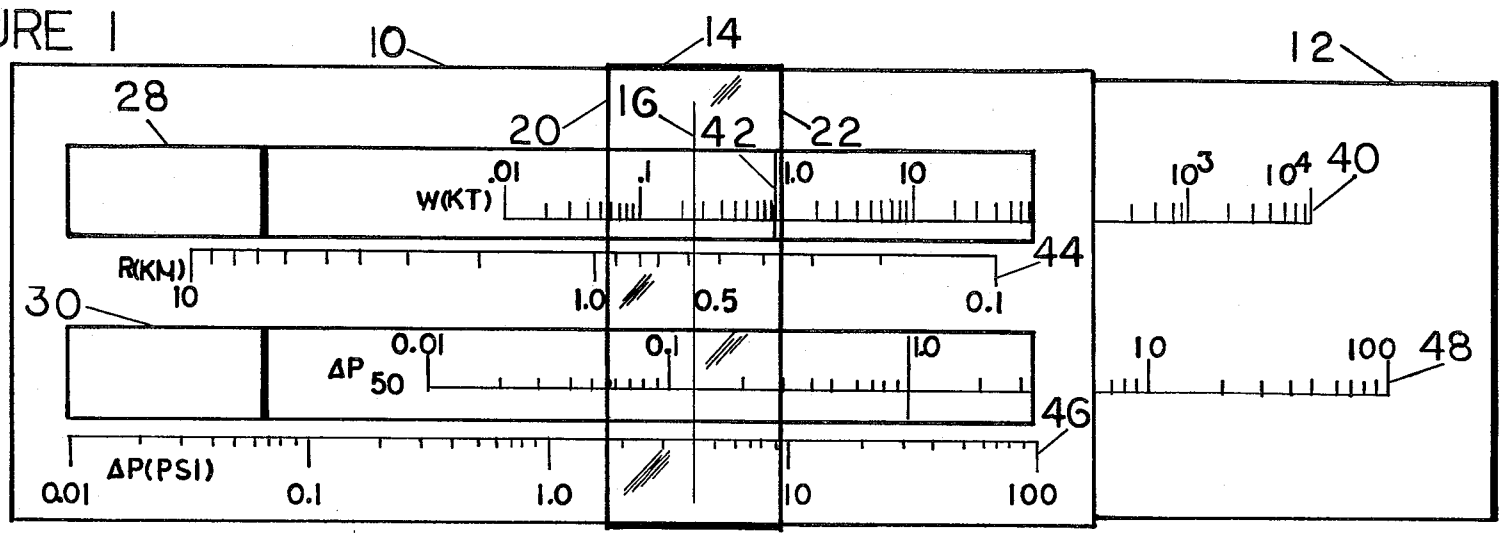
FIG. 1 shows a front view of the present inventive slide rule.
Figure 2:
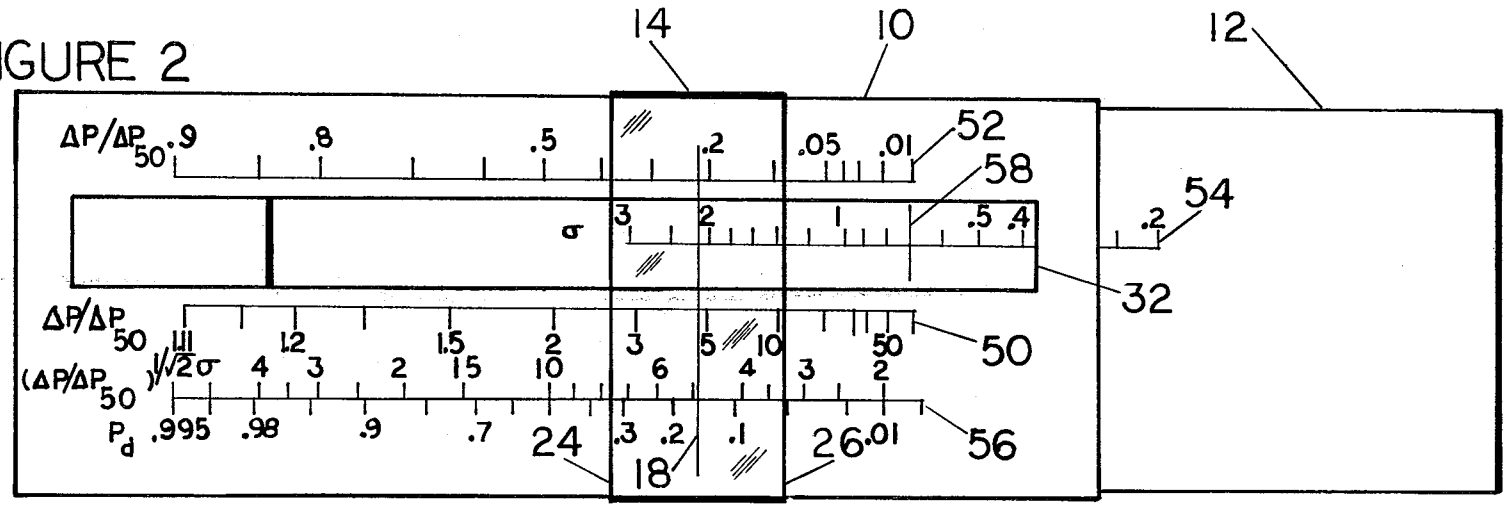
FIG. 2 shows a back view of the inventive slide rule.

In accordance with the previous objectives of the invention, a slide rule is provided as shown in FIGS. 1 and 2 of the drawing.

The slide rule comprises a stationary portion 10 combined and cooperating with a slide 12. The slide rule further comprises a transparent cursor 14 having two hairlines thereon, 16 and 18.

It is appreciated, of course, that a hair line need not be used, and that the cursor, shown as transparent in FIGS. 1 and 2, may merely be an opaque marker. Thus, edge 20 of the cursor may be used in the computations, as well as edges 22, 24 and 26.

It is further appreciated that scales described as being on the slide may be placed on the stationary portion, and those described as being on the stationary portion may be on the slide.

The slide rule further contains on the front face thereof windows 28 and 30 for display of the scales associated with slide 12. It is recognized that the scales may be arranged in any order, and that accordingly a single window may be used on the front face of stationary part 10 for display of any and all scales shown on the slide.

The back face of stationary part 10 similarly includes a window 32 for display of indicia printed on the back of slide 12.

The slide rule portions further include several scales, which may be engraved or printed on the slide and the stationary part, the scales having particular relationships as described in the sequel.

Referring now to FIG. 1 specifically, a first scale 40 is shown associated with slide 12 for display in window 28 of stationary portion 10. The particular scale is shown as having a label W, and pertains to a weapon yield W in kilotons. The scale 40 has associated therewith an index 42, which is used in the manner described below.

Stationary part 10 has thereon a scale 44, shown in the figure as being labeled R and providing a display of distance, R, of the item from the burst site. The specific scale of the presently preferred embodiment is graduated in kilometers. It is recognized that any of the scale factors utilized herein may be changed, as is known to those skilled in the art, upon a proper and appropriate change in the display numbers. Thus, R may be measured in miles, feet, or meters upon appropriately changing the values of the numerical indications adjacent the scale. Similarly, W may be shown in megatons rather than kilotons, or in any other convenient factor, upon similar appropriate changes in the display numerals.

As shown in the present embodiment, W is graduated in an increasing logarithmic scale, while R is shown in a decreasing logarithmic scale, when both scales are viewed from left to right. Of course, the scales may decrease, and increase, respectively. It is of no consequence to the basic scope of the invention that the increase take place from left to right or right to left. What is important is that the scales increase in opposite directions.

Yet another scale on the front face of stationary part 10 is shown at 46, and is labeled ΔP, symbolizing the environmental parameter to be calculated. Specifically, the static overpressure ΔP is calculated by the manipulation of slide 12 within the stationary part 10, and a subsequent adjustment of cursor 14.

It is noted that the numerical indicia on scale 46 increase in the same direction as those on scale 40, which is opposite to the direction of increase of the indicia on scale 44.

Finally, a scale 48 is shown on slide 12, representing essentially the same data represented by scale 46, increasing in the same direction and being similarly scaled thereto. The function of scale 48 in this situation is to provide a divisor for a quantity to be calculated and displayed on scale 46.

Operation of the scales hereinabove described is as follows.

To calculate the static overpressure on scale 46 of an object located a particular distance away from a weapon having a predetermined yield, the index 42 found on yield scale 40 is aligned with the particular distance parameter on scale 44. Cursor 14 is then displaced until hair line 16 is aligned with the actual weapon yield on scale 40, and the environmental parameter, specifically the static overpressure, is read under hair line 16 on scale 46.

The particular equation relating the yield, distance and pressure parameters is given below:

$$\Delta P = 1.61 W^{0.567} (R^{-1.70})$$

In prior art devices an attempt to solve the present equation for ΔP would require the raising of a particular number corresponding to the distance from the blast site to a first (negative) number, multiplying the result by a second number (corresponding to the weapon yield) raised to a second power, and multiplying the whole product by a constant, 1.61. While this can be done on an ordinary slide rule, each of the steps must be done separately, the numbers recorded, and finally a multiplication of the results performed, with all the inaccuracies implied therein. If the operation were to be performed on a calculator, again, each step needs to be done separately, the result stored, and a subsequent multiplication of the three factors performed. Such a computation, which loses the numbers being entered into the computation, is error-prone and time consuming. A programmed approach would permit calculation of the result of the equation by insertion of the parameters to determine the answer, but obviously requires the additional expenditures involved in purchasing a computer or a programmable calculator, and permits the computation to be carried in only one direction. That is, the converse calculation, when given a particular overpressure and distance, to determine the required weapon yield, necessitates the writing and implementation of a separate program. The present device overcomes the disadvantages mentioned and provides a display of the parameters entered to assure reliability, and moreover, does not require either storage of calculated data or generation of complex programs.

The transcendental equation shown above is solved in the present embodiment by conversion to the following form:

$$\ln \Delta P - \ln 1.61 = 0.567 \ln W + 1.7 \ln (R^{-1}).$$

The individual scales on the present slide rule are selected to provide the particular coefficients shown in the preceding equation, and further to provide for the proper relationship between weapon yield and distance.

That is, the R scale 44 is selected to be in a negative direction, or in a decreasing direction from left to right, to correspond with the negative power to which the distance is raised.

Further, in order to provide for solution of the present equation, the scales 40 and 44 are provided at scale factors having a ratio of 0.567 and 1.7 to that of scale 46. Finally, the scales are aligned so that scale 46 is displaced by a factor corresponding to the natural log of 1.61 from scales 40 and 44.

Proceeding with an illustrative example, the overpressure is desired for a weapon having a yield of three kilotons at a distance of 0.9 kilometers from the blast site. Accordingly, the index 42 is aligned with the distance of 0.9 on scale 44. Cursor 14 is then moved until hairline 16 corresponds with the indication of 3 on scale 40, and the static overpressure of 3.6 psi found under hairline 16 on scale 46.

The purpose of scale 48, not previously discussed, is to provide a ratio of static overpressure to the particular value of static overpressure at which an item will experience a probability of damage of 0.5. That is, a vulnerability parameter is injected into the computation for determination of the significance of the calculated environmental parameter, and the ratio of the two is utilized to obtain the ultimate probability of damage.

In the present example, the vulnerability parameter, $\Delta P_{50}$, is 2.4 psi. It is then determined that ΔP is in the ratio of 1.5 to $\Delta P_{50}$. This is done by entering the vulnerability parameter on scale 48, and obtaining the ratio to the indicated value on scale 46 in the normal slide rule manner. That is, scale 46 and 48 and the entries thereon are utilized in a manner similar to the use of scales "c" and "d" of an ordinary slide rule and the ratio determined thereby.

Turning now to FIG. 2, a first scale 50 is shown on the back of stationary part 10, representing the ratio obtained in the last step of the calculation performed with the scales of the front portion of the slide rule. The scale is shown in an inverse manner on scale 52, also on the back portion of part 10. A further scale 54, on the back side of slide 12, it utilized to perform a computation raising the determined ratio to a specific power, the resultant being again found on scale 50. Finally, a nomograph 56 is provided to convert the resultant, previously found on scale 50, to the desired answer, $P_d$.

Specifically, having computed the environmental ratio $\Delta P/\Delta P_{50}$, the probability of damage can be found from the following equation:

$$P_d = 0.5\left\{1 + erf\left([\ln(\Delta P/\Delta P_{50})]/\sqrt{2}\,\alpha\right)\right\}$$

The first computation, involving scales 50 and 54, is used to obtain a result $$Q = (\Delta P/\Delta P_{50})^{1/\sqrt{2}\,\sigma}$$

and the nomograph used to convert that result, (Q), to $$P_d = 0.5(1 = \text{erf} \ln Q)$$

To conclude the preceding example, the ratio $\Delta P/\Delta P_{50}$ was found to be 1.5. Entering the 1.5 number on scale 50 and moving index 58, on scale 54, to align with 1.5 on scale 50, one adjusts the hairline 18 to align with the value of the vulnerability parameter $\sigma$, relating to the way $P_d$ changes when $\Delta P$ changes, and finds the answer, Q, on scale 50. Specifically, for the present example, assuming sigma equals 0.4, upon placing index 58 adjacent 1.5 on scale 50 one finds that adjacent to $\sigma = 0.4$ on scale 54 is the number 2.05 on scale 50.

It is noted that if the ratio used were 0.66667, rather than 1.5 (the inverse thereof), one may enter such a number on scale 52, align index 58 therewith, and find the answer adjacent the value of sigma on scale 52.

The resultant number, in the present example, 2.05, is now entered at the upper scale of nomograph 56, and the answer, $P_d$ equals 0.84, located on the bottom scale of nomograph 56.

In accordance with the preceding specification, it has thus been shown that a means is provided for calculating the probability of damage to an item in reaction to a nuclear detonation. A single calculating means provides for computation of an environmental parameter upon determination of weapon yield and distance from the detonation site. Means is provided for computing a critical ratio of the environmental parameter to a first vulnerability parameter, and a further means provided to utilize a second vulnerability parameter with the critical ratio to compute the desired probability of damage.

The disclosed invention provides for straightforward, rapid and inexpensive calculation of the solution to a complicated equation, while simultaneously permitting the solution for any one of several parameters involved in the equation. Moreover, upon entering a parameter and moving to a next step, the parameter remains available for display.

The preceding specification describes, by way of illustration and not of limitation, a preferred embodiment of the invention. Inasmuch as the scope of the invention is recited with greater particularity in the following claims, I wish it to be understood that I do not desire to be limited to the exact details of construction shown and described, for obvious modifications can be made by a person skilled in the art.

What is claimed is:

1. Means for computing probability of damage to an item located a specified distance from a detonation site of a weapon having a predetermined yield comprising:

(a) stationary means, having a plurality of stationary means scales associated therewith, (b) slide means in sliding relationship with said stationary means and having a plurality of slide means scales associated therewith, (c) said stationary means scales and said slide means scales each comprising a plurality of indicia, (d) movable aligning means associated with said stationary means and with said slide means for aligning various indicia on the scales thereof, (e) one of said slide and stationary means having a first scale thereon having first indicia corresponding to values representative of weapon yield, said first indicia being spaced along said weapon yield scale at distances determined by a first scaling factor, (f) the other of said slide and stationary means having a first scale thereon having second indicia corresponding to values representative of distance from detonation site, said second indicia being spaced along said distance scale at distances determined by a second scaling factor, (g) the other of said slide and stationary means having a second scale having third indicia corresponding to values representative of an environmental parameter, said third indicia being spaced along said environmental parameter scale at distances determined by a third scaling factor, (h) said first scaling factor bearing a ratio to said third scaling factor of 0.567 and said second scaling factor bearing a ratio to said third scaling factor of 1.70, and said environmental parameter scale being displaced relative to said weapon yield and distance scales by a factor representative of the natural log of 1.61, whereby said environmental parameter may be calculated by aligning said first scales of said stationary and said slide means, by displacing said movable aligning means to correspond to said weapon yield, and by obtaining said environmental parameter from said second scale of said other of said slide and stationary means, adjacent said aligning means, (i) and means to determine said probability based on said calculated value of said environmental parameter.

2. Calculating means as recited in claim 1 wherein said weapon yield scale and said distance scale are monotonically increasing in opposite directions.

3. Calculating means as recited in claim 2 wherein said one of said slide and stationary means has a second scale associated therewith for representing values of a first vulnerability parameter, said vulnerability parameter scale being identical to said environmental parameter scale and being displaced relative to said weapon yield and distance scales by a factor representative of the natural log of 1.61 whereby a ratio of said calculated environmental parameter to said vulnerability parameter may be calculated by positioning the environmental parameter and vulnerability parameter scales such that the calculated value of the environmental parameter is aligned with a predetermined value of the vulnerability parameter.

4. Calculating means as recited in claim 3 wherein said one of said stationary means and said slide means has a third scale associated therewith for representing a second vulnerability parameter thereon.

5. Calculating means as recited in claim 4 wherein the other of said stationary means and said slide means has a third scale thereon comprising fourth indicia for representing the ratio of said environmental parameter to said first vulnerability parameter.

6. Calculating means as recited in claim 5 further comprising conversion means for directly converting from said ratio between said environmental parameter and said first vulnerability parameter to a number representing the probability of damage, said conversion means comprising nomograph means having a first portion thereof consisting of fifth indicia representative of values corresponding to said fourth indicia, and a second portion thereof consisting of sixth indicia representative of values corresponding to said probability, said fifth and sixth indicia being spaced along a common linear scale of said nomograph at differing distances determined by differing respective scaling factors whereby for any value of said ratio as represented by said fourth and fifth indicia, the value of said sixth indicia in alignment with said fifth indicia will represent the value of said probability.

7. Calculating means as recited in claim 6 wherein said one of said slide and stationary means is said slide means and said other of said slide and stationary means is said stationary means.

8. Means adapted to compute the probability of damage to an item located at a specified distance from a detonation site of a weapon, comprising first means comprising indications of first data values representative of weapon yield, second means comprising indications of second data values representative of distance from detonation site, third means associated and interrelated with said second means, comprising indications of third data values representative of an environmental parameter, manipulation means, comprising a base and slide member, for facilitating calculation of said environmental parameter in accordance with a predetermined relationship existing among said first, second and third values, wherein said base and slide member comprises means for correlating a known first data value and a known second data value, thereby giving an indication of said third data value representative of said environmental parameter, means for determining said probability from said calculated environmental parameter, said first means comprises visual indications of said first data values on one of said base and slide member, and said second and third means each comprises visual indications of said second and third data values on the other of said base and slide member, said first means further comprising logarithmic graduations representing said values of weapon yield, said values of weapon yield comprising first indicia spaced along a first scale at distances determined by a first scaling factor, said second means further comprising logarithmic graduations representing said values of distance from detonation site, said values of distance comprising second indicia spaced along a second scale at distances determined by a second scaling factor, said third means further comprising logarithmic graduations representing said values of said environmental parameter, said values of said environmental parameter comprising third indicia spaced along a third scale at distances determined by a third scaling factor, said first and second scaling factors bearing respective ratios to said third scaling factor which are determined by said relationship existing among said first, second and third data values, and said third scale being displaced relative to said first and second scales by a factor determined by said relationship existing between said first, second and third data values.

* * * * *